United States Patent [19]

Powell et al.

[11] 4,383,913

[45] May 17, 1983

[54] HYDROCRACKING TO PRODUCE LUBE OIL BASE STOCKS

[75] Inventors: Bruce E. Powell, Kensington; Jerome F. Mayer, San Anselmo; John A. Zakarian, Richmond, all of Calif.

[73] Assignee: Chevron Research Company, San Francisco, Calif.

[21] Appl. No.: 309,875

[22] Filed: Oct. 9, 1981

[51] Int. Cl.[3] ..... C10G 47/20; C10G 49/04; C10G 65/10

[52] U.S. Cl. ..... 208/59; 208/18; 208/89

[58] Field of Search ..... 208/59, 18, 89

[56] References Cited

U.S. PATENT DOCUMENTS 3,280,040 10/1966 Jaffe ..... 208/111 X 3,536,605 10/1970 Kittrell ..... 208/59

3,617,487 11/1971 Jaffe ..... 208/59

3,755,145 8/1973 Orkin ..... 208/18 X 4,263,127 4/1981 Rausch et al. ..... 208/58

*Primary Examiner*—Delbert E. Gantz

*Assistant Examiner*—G. E. Schmitkons

*Attorney, Agent, or Firm*—D. A. Newell; S. R. LaPaglia; C. L. Hartman

[57] ABSTRACT

A process for producing lubricating oil base stock from a feedstock having a VI of less than 80 to a base stock with a VI of at least 90 with the same boiling range as the feedstock. The feedstock is contacted with a zeolite-containing hydrocracking catalyst in a first zone and an amorphous hydrocracking catalyst in the second zone. Between 25 percent and 75 percent of all hydroconversion takes place in the first zone.

9 Claims, 3 Drawing Figures

CATALYST SYSTEM

| | VOL. % ZEOLITE-CONTAINING | VOL. % AMORPHOUS |
|---|---|---|
| □ | 0 | 100 |
| ◇ | 33 | 67 |
| △ | 50 | 50 |

HYDROCRACKING TO PRODUCE LUBE OIL BASE STOCKS

BACKGROUND OF THE INVENTION

The present invention relates to a hydrocracking process for converting feedstock to lube oil base stock. More particularly, the present invention relates to hydrocracking using two different types of catalysts to produce a lube oil stock from a high boiling hydrocarbon feedstock at a lower cost than from either catalyst separately.

There are several properties of interest in a hydrocarbon oil to be of use for lube oil base stock. One is viscosity, which is a measure of how readily a fluid flows at a given temperature. Another, an empirically defined value, is the viscosity index, as defined by ASTM D-2270, hereinafter "VI," which measures how an oil's viscosity changes with changes in temperature. Pure samples, or mixtures such as petroleum oils, may have the same viscosity at a first temperature, but quite different viscosities at a second temperature. It is desired that lube oil base stock have as little change in viscosity with changing temperature as possible, and this is represented by a high VI, usually 90 or above. Less desirable oils may have large changes in viscosity with temperature, and, therefore have lower VI's. Originally the VI scale ran from 0 to 100, but oils of greater than 100 VI are known, as are oils of less than 0 VI.

It is known that paraffinic compounds have higher viscosity indices than do naphthenic or aromatic compounds. Crude oils, however, generally contain aromatic, naphthenic, sulfur, oxygen and nitrogen compounds as well as paraffinic ones. If a lube oil base stock with a high viscosity index is desired, it is necessary to selectively remove a considerable portion of these low VI components from the feedstock.

The use of hydrocracking to produce lube oil base stock is a standard process. The hydrocracking catalyst selectively cracks low VI components to products with boiling points below those of the feedstock. The high VI components are not cracked and, thus, are concentrated in the heavy product having a similar boiling range as the feed, but with improved qualities for lube oil base stock. The light cracked products can be separated from the heavy lube oil product by distillation.

Due to the increasing shortage of light crudes, feedstocks of low API gravity are now being utilized to make petroleum products. The 700° F. to 1000° F. boiling range portion of these feedstocks, typical for distillate lube products, tends to have less high VI components than feedstocks of the same boiling range heretofore used. This means more low VI compounds will need to be cracked out of the feed boiling range than previously to produce a high VI lube oil base stock. Hydrocracking conversion levels must be quite high. This requires very low space velocities when using conventional amorphous hydrocracking catalysts, which requires large reactors.

Other catalysts that can be used to produce lube oil base stock from hydrocarbon feedstock include catalysts which contain a crystalline zeolitic component. Typical crystalline zeolitic components include faujasite and mordenite dispersed in an amorphous cracking catalyst base. These catalysts are more active for cracking than the amorphous silica-alumina or alumina based catalysts and a larger amount of feedstock can be cracked with a given catalyst volume. One drawback with zeolite-containing catalysts, however, is that the zeolite-containing catalysts are not as selective as the catalysts that do not contain zeolite; that is, they tend to crack desirable high VI components as well as the undesirable lower VI components.

Other two-stage hydrocracking processes are known for producing petroleum products. U.S. Pat. No. 3,617,487 discloses a process for producing jet fuel by contacting a heavy feedstock with a zeolitic catalyst and then an amorphous catalyst.

SUMMARY OF THE INVENTION

According to the present invention, a process is provided for producing lubricating oil base stock. A determination is made of the amount of hydroconversion required to convert a liquid hydrocarbon feedstock which has a VI of less than 80 into a lubricating oil base stock which has a VI of at least 90. The feedstock, in the presence of hydrogen, is passed through a first zone that contains a hydroprocessing catalyst that has a crystalline zeolitic molecular sieve disposed in a nonzeolitic hydrocracking matrix. The first zone is operated at elevated temperature and pressure to obtain 25 percent of 75 percent of the amount of hydroconversion required. At least a portion of the effluent from the first zone is then passed, in the presence of hydrogen, through a second zone that contains an amorphous hydroprocessing catalyst. The second zone is operated at elevated pressure and temperature to obtain the remaining conversion to obtain lubricating oil base stock.

The term "zeolite" or "zeolitic material" as used herein means crystalline zeolitic aluminosilicates. The zeolitic materials contained in the catalyst used for the first zone of the present invention can be any type that is known in the art as a useful catalyst or catalyst component for catalytic hydrocracking. These include faujasite, particularly Y-type and X-type faujasite, and other zeolitic materials.

The amorphous catalyst used in the second zone lacks the crystalline structure typical of the zeolite contained in the first zone catalyst. Usually, the zeolitic material used in the catalyst in the first zone has a pore size on the order to 5 to 15 Angstroms, whereas the amorphous catalyst of the second zone has a pore size on the order of 30 to 100 Angstroms. Preferably, the amorphous catalyst used in the second zone contains both Group VIB and Group VIII elements, in particular, either together with a silicaceous cracking support (e.g., a support comprising silica and alumina).

DETAILED DESCRIPTION

Figure 1:
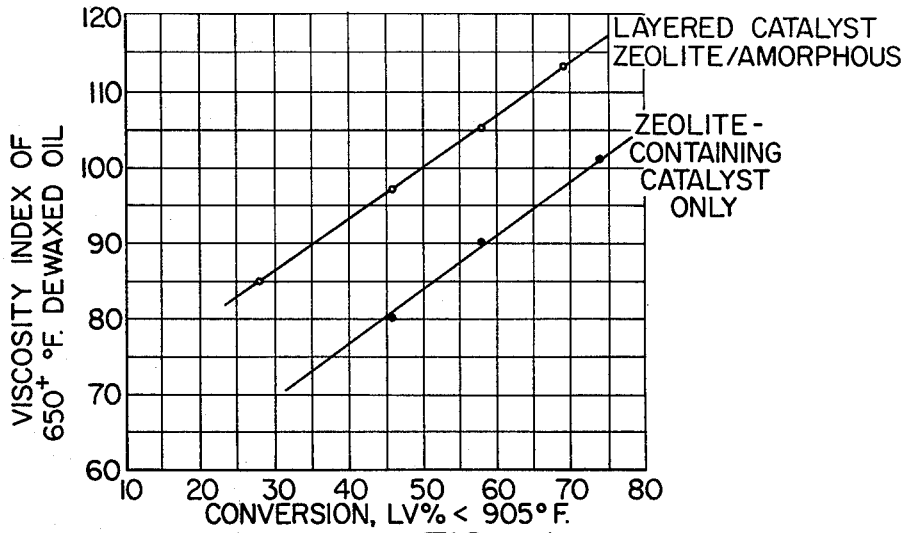
FIG. 1 shows a plot of the viscosity index of a dewaxed product vs. hydrocracking conversion.

It has been discovered that good-quality lube oil stock can be made from feedstock containing large amounts of low VI components by passing the feedstock first over a catalyst containing a zeolitic component and then over an amorphous silica-alumina catalyst. Higher yields of high VI product are obtained with lower reactor volume than if either catalyst were used separately.

The feedstock for this invention will normally be heavy vacuum gas oil and deasphalted residuum cuts. Feedstocks of the type described tend to have high boiling ranges, typically above 700° F., and low VI's, in particular, less than 80.

Feedstocks from different sources but having the same boiling ranges are not necessarily composed of the same compounds, in the same proportions. Therefore, the viscosity indices of various liquid hydrocarbon fractions, that initially have identical boiling ranges and identical viscosities at a given temperature, can vary greatly. It is known that the highest viscosity index products, and therefore the most desirable for lubricating oil base stock, are the long chain paraffins. Normal alkanes have very good viscosity response to temperature but they tend to solidify at low temperatures, raising the pour point of compositions containing them. Therefore, alkanes with a few branches are the preferred lube oil base stock. In some feedstocks, large polycyclic naphthenic and aromatic compounds are the major components. These compounds, while they may have similar boiling properties, have very low VI's.

In the present invention, a feedstock to be processed having a VI of less than 80 is passed through a first zone containing a hydrocracking catalyst that contains zeolite and then through a second zone containing a hydrocracking catalyst that does not contain zeolite. The conditions, in particular temperature, space velocity, and hydrogen partial pressure, of the reaction vessel or vessels that contain the two catalysts, hereinafter the "reactor," can be varied to convert more or less of the feedstock. A feedstock containing mostly high VI components requires less conversion than a lower quality feedstock containing more low VI components to produce a lube oil base stock having the same boiling range as the feedstock and a VI of at least 90.

The amount of hydrocracking to be done to render a suitable lube oil base stock varies with the origin of the oil. Conventionally, the amount of hydroconversion required is derived empirically, by hydroconverting small quantities of a given feedstock to different percentages of hydroconversion and anaylzing the VI's of the products. In this way, poor VI feedstock can be hydroconverted to obtain some amount, many times a small amount, of a product having a VI greater than 90 and an initial boiling point at least as great as the feedstock that is suitable for use as lube oil base stock.

The hydrocracking catalyst of the first zone, hereinafter "the first catalyst," tends to rid the feedstock of unwanted heteroatoms and saturate aromatic rings. By limiting conversion of the first catalyst, damage to the paraffinic chains of the high VI molecules is limited. At least part of the effluent from the first zone is then passed to the second zone containing a second catalyst where the remaining aromatic molecules are saturated to naphthenic compounds; remaining heteroatoms are removed and naphthenic rings are opened, leaving unreacted branched chain paraffins with high VI. Since the catalyst of the second zone tends not to crack paraffins, the high VI molecules are not destroyed as they might be if in contact with the catalyst of the first zone.

In the present invention, it will be empirically determined how much total conversion of a feedstock that has a VI of less than 80 is required to produce a lube oil base stock with a VI of greater than 90. At least 25 percent to 75 percent of the total conversion should take place in the first catalyst zone, and the balance in the second catalyst zone.

Hydroconversion will preferentially be done at between 650° F. and 800° F., at between 0.4 and 2.5 LHSV, under a pressure of between 1500 and 3000 psig total pressure, and hydrogen pressure of 1000 to 2500 psig.

A two-zone catalyst process as described gives higher yields of high VI product than a reactor containing only zeolite-containing catalysts, while using a smaller reactor volume than if only a nonzeolite-containing catalyst was used.

In the present invention, conditions in the two zones are changed as necessary with new feedstocks, to maximize the production of high VI product. It is believed that under actual processing conditions at a refinery, the best method of varying conditions in the catalyst beds is changing bed temperatures.

It should be noted that the zeolite-containing catalyst should always be the first catalyst to contact the feedstock, because if the catalyst beds are reversed, the feedstock would already be partially cracked and the zeolite-containing catalyst would crack the desired high VI products, predominantly paraffins, thereby destroying them. It is believed that the zeolite-containing catalyst may be inhibited to some degree by the high nitrogen levels of the feedstock, therefore, it has less cracking activity than it would have in the absence of nitrogen-containing molecules.

One preferred embodiment is to have one reactor vessel contain both catalysts. In such an embodiment, a feedstock would flow directly from the first catalyst to the second catalyst and be converted into product. It has been found that the process of the present invention can be practiced if the first zone contains between 10 volume percent and 50 volume percent of zeolite-containing catalyst and the second zone contains between 90 volume percent and 50 volume percent of an amorphous refractory inorganic oxide hydrocracking catalyst where volume percent is calculated as percent of total amount of catalyst in both zones. It has been found in the case where 50 percent of the catalyst is zeolite catalyst, that more than 50 percent of the cracking takes place in the zeolite catalyst-containing zone without degradation of the VI of the final product. If the feedstock is cracked over a catalyst comprising only zeolite-containing catalyst, the yields of high VI product will be adversely affected.

The zeolite-containing catalyst will be a nonzeolitic hydrocracking matrix having disposed crystalline zeolite. The crystalling zeolite is faujasite. The nonzeolitic hydrocracking matrix will typically be a refractory inorganic oxide base, for example, alumina, silica, boria, magnesia, titania, and the like, or a combination of oxides, for example, alumina and silica.

The zeolite-containing catalyst may also contain catalytic metals, in particular, metals selected from the group consisting of Group VI and Group VIII Transition metals. Various combinations of the metals can be used, for example, cobalt/molybdenum, nickel/molybdenum, cobalt/tungsten, nickel/tungsten, and the like. Catalytic metals may be present in quantities of up to 10 weight percent for Group VIII metals and from 10 to 25 weight percent for Group VI metals, when weight percent is measured as percent of reduced metal compared to total catalyst weight.

The amorphous catalyst will be a refractory inorganic oxide base, for example, alumina, silica, boria, magnesia, titania, and the like, or combinations of oxides, for example, alumina and silica.

The amorphous catalyst may contain catalytic metals as well, in particular, those selected from Group VI and Group VIII Transition metals. Combinations of metals may be used, as exemplified above. Catalytic metals may be present of quantities of up to 10 weight percent for Group VIII metals and from 2 to 25 weight percent for Group VI metals, when weight percent is calculated as percent of reduced metal on the finished catalyst particles.

In a preferred embodiment, the nonzeolitic hydrocracking matrix of the zeolite-containing catalyst and the amorphous hydrocracking catalyst are manufactured by the same process; therefore, the hydrocracking matrix of the first catalyst is substantially the same as the amorphous second catalyst. It should be clear, however, that a hydrocracking matrix made by any process can be used with any amorphous hydrocracking catalyst as long as the first catalyst contains zeolite.

An example of an alumina-silicate zeolite-containing hydrocracking catalyst suitable for use in the first stage of the present invention is disclosed in U.S. Pat. No. 3,536,605, issued to J. R. Kittrell, which is hereby incorporated herein as reference. An example of an alumina-silicate hydrocracking catalyst suitable for use in the second stage of the present invention is disclosed in U.S. Pat. No. 3,280,040, issued to Joseph Jaffe, which is hereby incorporated by reference.

EXAMPLE 1

This example demonstrates the adverse effect of using a zeolite-containing catalyst only, compared to a two-catalyst system. The feed is a solvent deasphalted oil which was mildly hydrocracked and distilled to give a vacuum gas oil boiling in the range of 900° F. to 1000° F. The vacuum gas oil has the following properties:

| | |
|---|---|
| °API | 23.8 |
| Sulfur | 650 ppm |
| Nitrogen | 875 ppm |
| Viscosity Index (dewaxed oil) | 70 |

The feed was hydrocracked in two different experiments to compare catalyst performance. In the first experiment, the feed was contacted with a zeolite-containing catalyst only and in the second experiment, the feed was contacted with a catalyst bed that consisted of 33 volume percent of zeolite-containing catalyst on top of 67 volume percent amorphous catalyst. FIG. 1 plots the viscosity index of the 650+° F. dewaxed product vs. hydrocracking conversion. The data clearly show that at the same hydrocracking conversion, the experiment using only zeolite-containing catalyst gives a product with a VI of about 16 numbers less than the experiment with the layered catalyst system. The hydrocracking conditions for both reactors were: 1.0 LHSV, 2200 psig total pressure, and 2500 SCF/B once-through $H_2$ flow rate.

EXAMPLE 2

This example also demonstrates the adverse effect of using only a zeolite-containing catalyst, compared to a two-catalyst system. The feed is a solvent deasphalted oil which was mildly hydrocracked. The once-hydrocracked product was distilled to give an oil boiling above 730° F. This oil has the following properties:

| | |
|---|---|
| °API | 23.5 |
| Sulfur | 820 ppm |
| Nitrogen | 765 ppm |
| Viscosity Index (dewaxed oil) | 65 |

Figure 2:
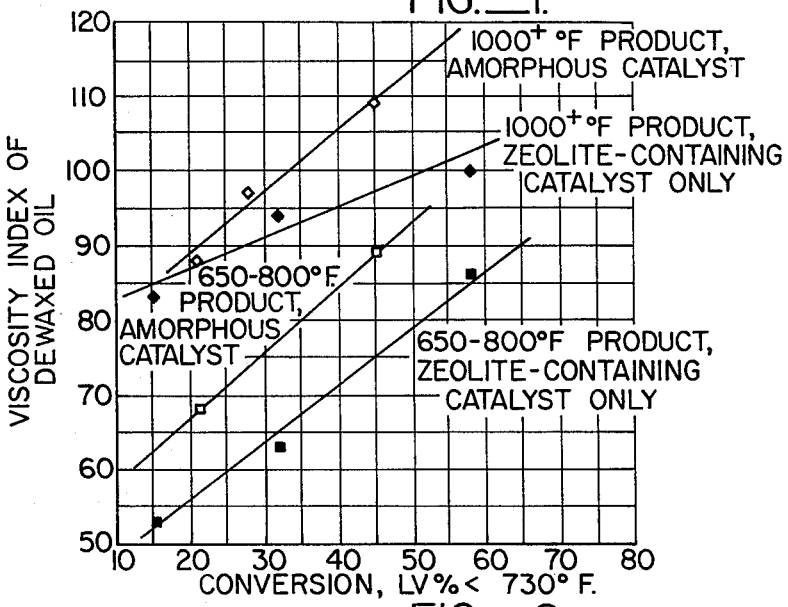
FIG. 2 shows a plot of the viscosity index of a dewaxed oil as a function of hydrocracking conversion over zeolite-containing catalyst and amorphous catalyst.

This feed was hydrocracked in two different experiments, as in Example 1, with the same reactors and hydrocracking conditions described in Example 1. FIG. 2 shows the viscosity index of the dewaxed oil as a function of hydrocracking conversion. Two dewaxed oil products are shown—a 1000+° F. product and a 650° F. to 800° F. product. As in FIG. 1, the reactor consisting only of zeolite-containing catalyst yields a poorer viscosity index at a given conversion compared to the reactor consisting of two catalysts.

Because the conversion required to achieve a given VI is lower with the two-catalyst system, the yields of lube oil base stock are higher; and because the zeolite-containing catalyst has a higher activity and is capable of converting more feedstock in a given catalyst volume than the amorphous catalyst, the reactor is smaller than that required with a 100 percent amorphous catalyst system.

EXAMPLE 3

This example demonstrates that the composition of the two-catalyst system can vary from 0 to 50 volume percent of the zeolite-containing catalyst without adverse effect on the product viscosity index. The feed is a straight run stock boiling in the range of 800° F. to 1000° F. The feed properties are:

| | |
|---|---|
| °API | 18.0 |
| Aniline Point | 173.0° F. |
| Sulfur | 1.11 wt. % |
| Nitrogen | 2900 ppm |
| Viscosity Index (dewaxed oil) | 3 |

This feed was hydrocracked with three different catalyst systems. The compositions of these catalyst systems are listed in the table below.

TABLE 1

| Catalyst System | Vol. % Zeolite-Containing Catalyst | Vol. % Amorphous Catalyst |
|---|---|---|
| A | 0 | 100 |
| B | 33 | 67 |
| C | 50 | 50 |

The hydrocracking conditions for each system were: 0.7 to 1.0 LHSV 2000 to 2200 psig total pressure, and 4000 SCF/B recycle $H_2$.

Figure 3:
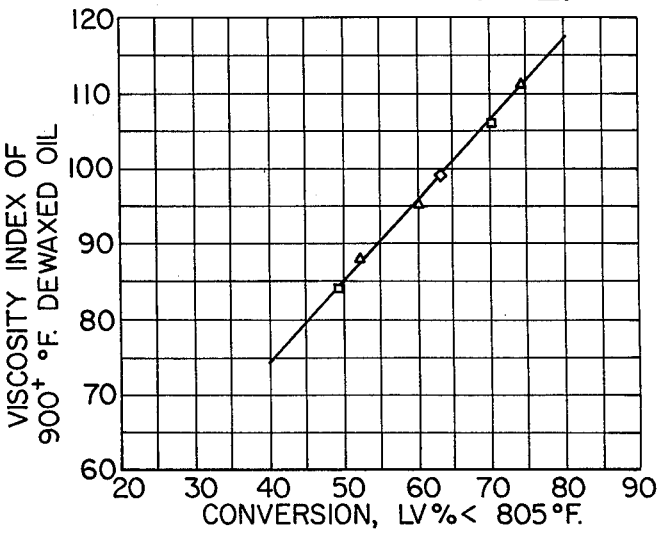
FIG. 3 plots the viscosity index of a dewaxed oil vs. conversion for various layered systems.

FIG. 3 plots the viscosity index of the 900+° F. dewaxed oil product vs. hydrocracking conversion. The data for each catalyst system all fall on the same line, which demonstrates that as much as 50 volume percent of zeolite-containing catalyst can be used in the reaction system with no decline in product quality. However, as Examples 1 and 2 demonstrate, the use of 100 volume percent zeolite-containing catalyst causes a decline in product viscosity index.

We claim:

1. A process for producing lubricating oil base stock comprising:

(a) passing a liquid hydrocarbon feedstock, having a VI of less than 80, in the presence of hydrogen, through a first zone containing a first catalyst having a crystalline molecular sieve disposed in a nonzeolitic hydrocracking matrix, said first zone being operated at elevated temperature and pressure to obtain between 25 percent and 75 percent of said hydroconversion to create a lubricating oil base stock having a minimum boiling point equal to the minimum boiling point of said feedstock and a VI of at least 90, and producing an effluent of partially hydroconverted feedstock; and (b) passing at least a portion of said effluent, in the presence of hydrogen, through a second zone containing a second catalyst comprising an amorphous refractory inorganic oxide and catalytic metals selected from the group consisting of Group VI and Group VIII metals, said second zone being operated at elevated temperature and pressure to obtain said lubricating oil base stock.

2. The process of claim 1 including on said first catalyst up to 10 weight percent Group VIII and from 10 to 25 weight percent Group VI metals.

3. The process of claim 1 including on said second catalyst up to 10 weight percent Group VIII and from 2 to 25 weight percent Group VI metals.

4. The process of claim 1 wherein the feedstock is a liquid hydrocarbon boiling above 700° F.

5. The process of claim 1 wherein said first zone contains 10 volume percent to 50 volume percent of said zeolite-containing catalyst and said second zone contains 90 volume percent to 50 volume percent of said amorphous catalyst.

6. The process of claim 1 wherein said first zone and said second zone are contained in the same reactor.

7. The process of claim 1 wherein said first zone and said second zone are contained in separate reactors.

8. The process of claim 1 including varying the temperature of said first and said second zones to vary the amount of hydroconversion in said first zone.

9. The process of claim 1 wherein said nonzeolitic hydrocracking matrix of said first catalyst is manufactured by the same process as said second catalyst.

* * * * *